US009702637B2

(12) United States Patent
Okazaki et al.

(10) Patent No.: US 9,702,637 B2
(45) Date of Patent: Jul. 11, 2017

(54) HEAT EXCHANGER, INDOOR UNIT, AND REFRIGERATION CYCLE APPARATUS

(75) Inventors: Takashi Okazaki, Tokyo (JP); Akira Ishibashi, Tokyo (JP); Sangmu Lee, Tokyo (JP); Takuya Matsuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 276 days.

(21) Appl. No.: 14/391,487

(22) PCT Filed: Apr. 26, 2012

(86) PCT No.: PCT/JP2012/002881

§ 371 (c)(1),
(2), (4) Date: Oct. 9, 2014

(87) PCT Pub. No.: WO2013/160957

PCT Pub. Date: Oct. 31, 2013

(65) Prior Publication Data

US 2015/0059400 A1 Mar. 5, 2015

(51) Int. Cl.
*F25B 39/02* (2006.01)
*F28F 1/12* (2006.01)
(Continued)

(52) U.S. Cl.
CPC ..... *F28F 1/12* (2013.01); *F24F 1/0007* (2013.01); *F24F 13/30* (2013.01); *F25B 1/005* (2013.01); *F25B 13/00* (2013.01); *F25B 39/028* (2013.01); *F28D 1/0478* (2013.01); *F28F 1/022* (2013.01); *F28F 1/32* (2013.01); *F25B 2313/006* (2013.01);
(Continued)

(58) Field of Classification Search
CPC ..... F25B 39/02; F25B 1/10; H01L 23/427; F28D 15/0266
USPC ..... 62/498, 524; 165/148, 173, 174, 181, 165/104.21
See application file for complete search history.

(56) References Cited

U.S. PATENT DOCUMENTS

2010/0205993 A1* 8/2010 Matsuda ..... F24F 1/0059 62/259.1
2011/0094258 A1* 4/2011 Lee ..... F28D 1/0478 62/498

FOREIGN PATENT DOCUMENTS

JP S62-005050 A 1/1987
JP 63-231123 A 9/1988
(Continued)

OTHER PUBLICATIONS

Chinese Office Action issued on Nov. 2, 2015 in the corresponding CN application No. 201280073172.0 (English translation attached).
(Continued)

*Primary Examiner* — Melvin Jones
(74) *Attorney, Agent, or Firm* — Posz Law Group, PLC

(57) ABSTRACT

The heat exchanger includes heat exchange units. Each of the heat exchange units includes a plurality of plate fins and a plurality of flat tubes. The plate fins are arranged spaced apart from one another at intervals so as to allow air to flow therebetween. The flat tubes each have an L shape by bending and inserted through the plate fins so that a refrigerant flows therethrough in a direction in which the plate fins are arranged. The heat exchange units are combined to each other so as to form a rectangular shape. Thus, heat exchange can be efficiently performed by increasing the mounting area.

9 Claims, 5 Drawing Sheets

(51) Int. Cl.

| | |
|---|---|
| ***F24F 13/30*** | (2006.01) |
| ***F24F 1/00*** | (2011.01) |
| ***F28D 1/047*** | (2006.01) |
| ***F28F 1/02*** | (2006.01) |
| ***F28F 1/32*** | (2006.01) |
| ***F25B 1/00*** | (2006.01) |
| ***F25B 13/00*** | (2006.01) |
| *F28D 1/02* | (2006.01) |

(52) U.S. Cl.

CPC ..... *F25B 2313/02741* (2013.01); *F25B 2341/0661* (2013.01); *F28D 1/0471* (2013.01); *F28D 1/0476* (2013.01); *F28D 2001/0273* (2013.01)

(56) References Cited

FOREIGN PATENT DOCUMENTS

| | | | |
|---|---|---|---|
| JP | H01-131851 | A | 5/1989 |
| JP | 09-280587 | A | 10/1997 |
| JP | 2003-161589 | A | 6/2003 |
| JP | 2003-287239 | A | 10/2003 |
| JP | 2003-287390 | A | 10/2003 |
| JP | 2007-147144 | A | 6/2007 |
| JP | 2010-127511 | A | 6/2010 |
| JP | 2010-185614 | A | 8/2010 |
| JP | 2010-249374 | A | 11/2010 |
| JP | 2012-032089 | A | 2/2012 |
| WO | 2008/041656 | A1 | 4/2008 |

OTHER PUBLICATIONS

Office Action issued Dec. 15, 2015 in the corresponding JP application No. 2014-512026 (with English translation).

Extended European Search Report issued Feb. 18, 2016 in the corresponding EP application No. 12875061.9.

Office Action mailed Jun. 23, 2015 issued in corresponding JP patent application No. 2014-512026 (and English translation).

International Search Report of the International Searching Authority mailed Jun. 12, 2012 for the corresponding international application No. PCT/JP2012/002881 (and English translation).

Japanese Office Action mailed on Sep. 15, 2015 in the corresponding JP Application No. 2014-512026.(English translation attached).

Office Action dated May 3, 2016 issued in corresponding CN patent application No. 201280073172.0 (and English translation).

* cited by examiner (a)

(b)

(c)

(a)

(b)

HEAT EXCHANGER, INDOOR UNIT, AND REFRIGERATION CYCLE APPARATUS

CROSS REFERENCE TO RELATED APPLICATION

This application is a U.S. national stage application of PCT/JP2012/002881 filed on Apr. 26, 2012, the contents of which are incorporated herein by reference.

TECHNICAL FIELD

The present invention relates to indoor units and the like that perform air-conditioning of air-conditioned spaces.

BACKGROUND

There exist related-art four-way cassette-type indoor units that can be ceiling mounted in air-conditioned spaces. Such indoor units have a structure in which, for example, an outer peripheral portion (laterally side portions) of an air-sending device such as a turbofan is surrounded by heat exchanger. The air-sending device sucks air from below and laterally blows the sucked air so that the air is air-conditioned by passing through the heat exchanger, and the air-conditioned air is blown to the air-conditioned space. In the heat exchanger of such an indoor unit, headers are disposed at upper and lower positions, a plurality of flat tubes are arranged in the up-down direction (vertical direction) between the headers, and corrugated fins are disposed between the flat tubes (see, for example, Patent Literature 1).

Patent Literature

Patent Literature 1: Japanese Unexamined Patent Application Publication No. 2007-147144 (FIG. 4)

As described above, in the four-way cassette-type indoor unit, a rectangular (quadrangle) enclosure is formed, and the four sides of the enclosure are formed by the heat exchanger. However, as is the case with the indoor unit of the above-described Patent Literature 1, when the headers, which have a rigid structure so as to have, for example, a pressure-resistant property, are provided at the upper and lower positions, it is difficult to perform bending on the heat exchanger.

Thus, in the indoor unit described in the above-described Patent Literature 1, four heat exchangers (heat exchanger units) are disposed on the four sides, thereby surrounding the air-sending device in four directions. When the header or the like is provided in each of the units, the mounting area (area opposing the air) that contributes to actual heat exchange is reduced in the heat exchanger, and accordingly, heat exchange performance is reduced. In order to obtain the capacity, an increased number of short flat tubes are provided. This increases the number of branches of the refrigerant, and accordingly, distribution of the refrigerant at the header becomes difficult.

SUMMARY

The present invention is proposed to address the above-described problem. An object of the present invention is to provide a heat exchanger and the like, which is disposed so as to oppose the flows of air in, for example, a plurality of directions and with which heat exchange can be efficiently performed.

A heat exchanger according to the present invention includes heat exchange units. Each of the heat exchanger units includes a plurality of plate fins and a plurality of flat tubes. The plate fins are arranged spaced apart from one another at intervals so as to allow air to flow therebetween. The flat tubes each have an L shape and are inserted through the plate fins so that a refrigerant flows therethrough in a direction in which the plate fins are arranged. The heat exchange units are combined to each other so as to form a rectangular shape.

According to the present invention, the heat exchange units, which include the flat tubes bent into the L-shape, are combined to each other to form the rectangular heat exchanger. Thus, for example, in a four-way cassette-type indoor unit, the mounting area can be increased compared to a heat exchanger that includes four heat exchange units to form an enclosure. Furthermore, since the rectangular shape is formed by combining the L-shaped heat exchange units with each other, the pressure loss of the refrigerant flowing through channels can be reduced. Thus, heat exchange can be efficiently performed.

DETAILED DESCRIPTION

Embodiment 1

Figure 1:
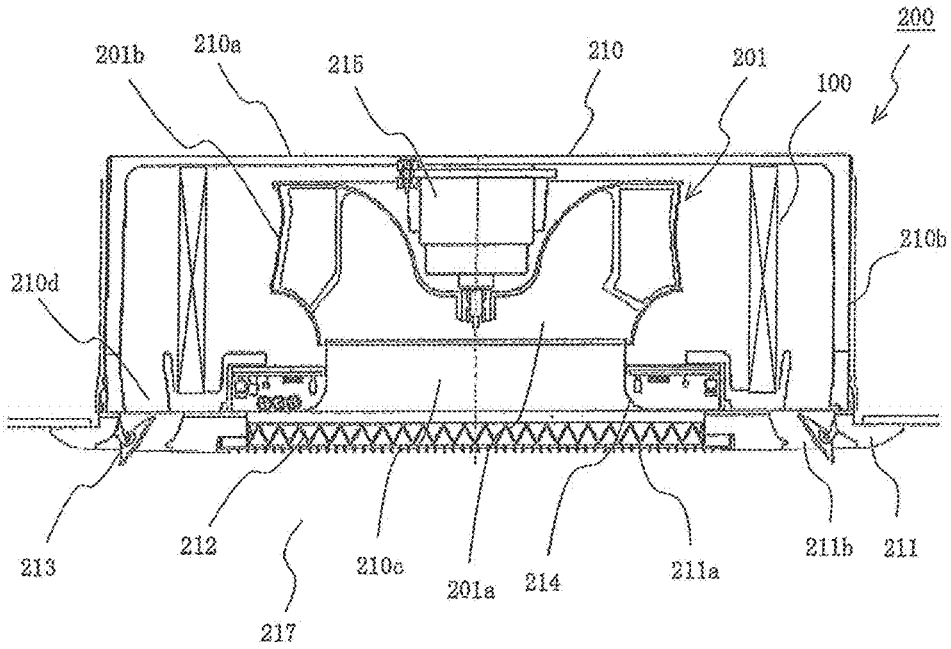
FIG. 1 is a longitudinal sectional view of an indoor unit according to Embodiment 1 of the present invention.

FIG. 1 is a longitudinal sectional view of an indoor unit according to Embodiment 1 of the present invention. In Embodiment 1, a four-way cassette-type indoor unit that can be embedded in a ceiling is described. In FIG. 1, the upper side (in the vertical direction) in the page represents the upper side and the lower side in the page represents the lower side. The indoor unit is connected to an outdoor unit through refrigerant pipes to form a refrigerant circuit, in which a refrigerant is circulated for operations such as refrigeration and air-conditioning.

As illustrated in FIG. 1, a four-way cassette-type indoor unit 200 is installed such that a top plate 210*a* thereof is disposed on the upper side relative to a room 217. A side plate 210*b* is attached around the top plate 210*a*. Thus, a housing 210 is provided so as to open toward the room 217. On a lower portion of the indoor unit 200, a decorative panel 211, which has a substantially quadrangle shape in plan view, is attached so as to face the room 217. An air inlet grille 211*a* and a filter 212 are provided near the center of the decorative panel 211. The air inlet grille 211*a* serves as an air inlet, through which air is sucked into the indoor unit 200. The filter 212 removes dust from the air having passed through the air inlet grille 211*a*. The decorative panel 211 has panel air outlets 211*b* formed along sides thereof. The panel air outlets 211*b* serve as air outlets. Each of the panel air outlets 211*b* is provided with a wind-direction vane 213.

The indoor unit 200 has a unit air inlet 210*c* provided at a central portion of a lower surface thereof. The unit air inlet 210*c* serves as an inlet, through which the air flows into a main body. The indoor unit 200 also has a unit air outlet 210*d* provided around the unit air inlet 210*c*. The unit air outlet 210*d* serves as an outlet, through which the air flows out of the main body. The air inlet grille 211*a*, the unit air inlet 210*c*, the unit air outlet 210*d*, and the panel air outlets 211*b* communicate with one another.

The indoor unit 200 includes therein a turbofan 201, a bell mouth 214, a fan motor 215, and a heat exchanger 100. The turbofan 201 is a centrifugal-type air-sending device including a rotational shaft disposed in the vertical direction. The turbofan 201 generates air flows to blow the air sucked through the air inlet grille 211*a* in lateral directions (horizontal directions in FIG. 1). Although the turbofan 201 is used as the air-sending device here, the present invention is not limited to this. For example, a sirocco fan, a radial fan, or the like may also be used as the air-sending device. The bell mouth 214 forms a suction air passage of the turbofan 201 and regulates the flow. The fan motor 215 rotates the turbofan 201.

The finned tube-type heat exchanger 100 is disposed downstream of the turbofan 201 so as to surround the turbofan 201. When the indoor unit of Embodiment 1 is applied to, for example, an air-conditioning apparatus, the heat exchanger 100 functions as an evaporator in a cooling operation and functions as a condenser in a heating operation. Here, in Embodiment 1, all the components that form the heat exchanger 100 are made of aluminum or alloys containing aluminum.

Figure 2:
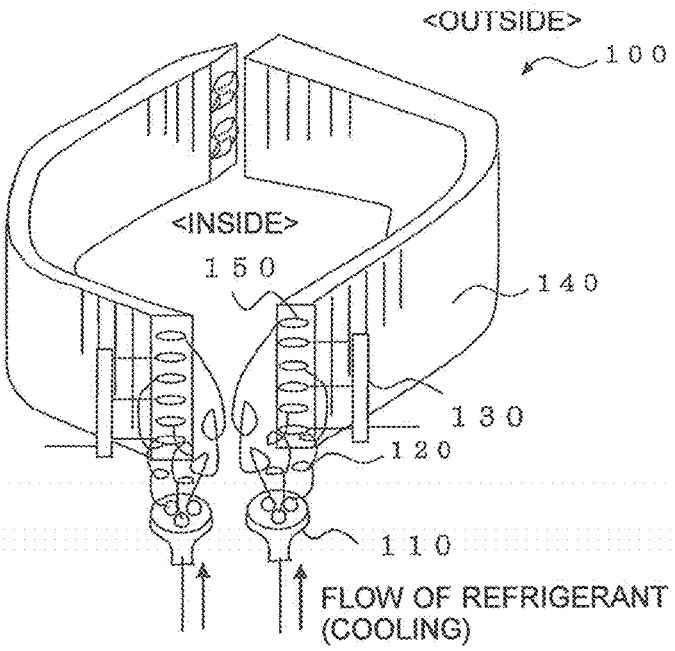
FIG. 2 is a schematic view explaining a configuration of a heat exchanger 100 according to Embodiment 1 of the present invention.

FIG. 2 is a schematic view explaining a configuration of the heat exchanger 100 according to Embodiment 1 of the present invention. The heat exchanger 100 of Embodiment 1 includes two L-shaped heat exchange units that, as will be described later, each correspond to air flows in two directions and that are combined together to form a substantially rectangular enclosure, thereby surrounding the turbofan 201 as illustrated in FIG. 1. The heat exchange units include plate fins 140 and flat tubes 150. Each of the heat exchange units at least includes a distributor 110, flow rate-regulating capillary tubes 120, and header 130.

The distributors 110 and the flow rate-regulating capillary tubes 120 serve as refrigerant branching and combining means that is connected to refrigerant inlets/outlets of the flat tubes 150 and causes a flow of the refrigerant to branch, and the headers 130 serves as the refrigerant branching and combining means that is connected to the refrigerant inlets/outlets of the flat tubes 150 and causes flows of the refrigerant to combine with one another. When the heat exchanger 100 functions as the evaporator, the distributors 110 each distribute a two-phase gas-liquid refrigerant (including a liquid refrigerant) flowing from the refrigerant pipe on the liquid side to the flat tubes 150 through the flow rate-regulating capillary tubes 120. When the heat exchanger 100 functions as the condenser, the distributors 110 each cause the flows of the liquid refrigerant (including the two-phase gas-liquid refrigerant) flowing from the flat tubes 150 through the flow rate-regulating capillary tubes 120 to be combined with one another and to flow into the refrigerant pipe on the liquid side. The flow rate-regulating capillary tubes 120 are disposed between the distributors 110 and the flat tubes 150. The flow rate-regulating capillary tubes 120 regulate the flow rate so as to cause the refrigerant relating to distribution by the distributors 110 to uniformly flow into the flat tubes 150. When the heat exchanger 100 functions as the evaporator, the headers 130 cause the flows of the gaseous refrigerant (including the two-phase gas-liquid refrigerant) flowing from the flat tubes 150 to be combined with one another and to flow into the refrigerant pipe on the gas side. When the heat exchanger 100 functions as the condenser, the headers 130 cause the gaseous refrigerant flowing from the refrigerant pipe on the gas side to branch and flow into the flat tubes 150. Here, in Embodiment 1, when, for example, the heat exchanger 100 functions as the evaporator, the refrigerant inlets of the flat tubes 150 are connected to the distributors 110 and the flow rate-regulating capillary tubes 120, and the refrigerant outlets are connected to the headers 130. However, the present invention is not limited to this. For example, the headers may be connected to both the inlets and the outlets. Although each of the heat exchange units at least includes the distributor 110, the flow rate-regulating capillary tubes 120, and the header 130 in Embodiment 1, the present invention is not limited to this. For example, a single distributor 110 may distribute the refrigerant to the flat tubes 150 of a plurality of heat exchange units. Alternatively, the flows of refrigerant from a plurality of heat exchange units may be combined with one another by a single header 130.

Figure 3:
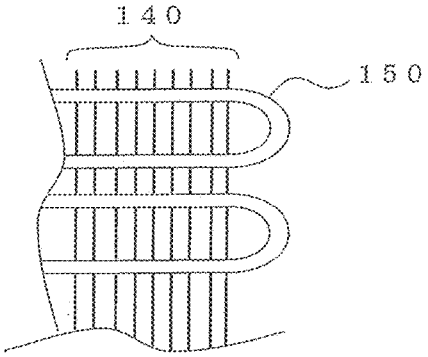
FIG. 3 includes views illustrating the relationships between plate fins 140 and flat tubes 150 according to Embodiment 1 of the present invention.
Figure 3:
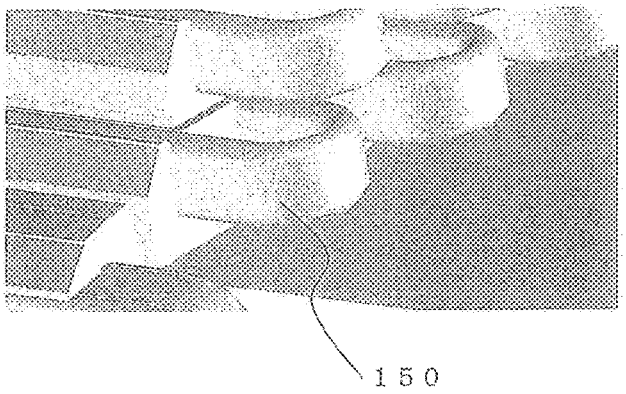
Figure 3:
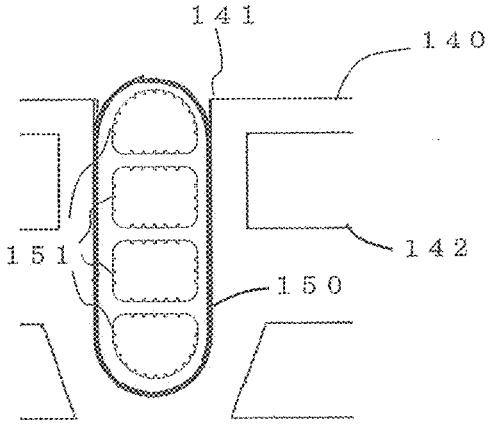

FIG. 3 includes views illustrating the relationships between the plate fins 140 and the flat tubes 150 according to Embodiment 1 of the present invention. View (a) of FIG. 3 is seen in a direction in which the air flows from the turbofan 201. View (b) of FIG. 3 is an enlarged view of folded portions. View (c) of FIG. 3 is an enlarged view of parts of the plate fin 140 and the flat tube 150 taken along a plane parallel to the plate fins 140. Each of the flat tubes 150 is a flat heat transfer tube. In the section of the flat tubes 150, long side portions are linear and short side portions are curved into, for example, a semi-circular shape or the like. The plurality of flat tubes 150 are parallel to one another and spaced apart from one another at regular intervals in a direction perpendicular to a direction in which the refrigerant flows in the tubes. Here, in Embodiment 1, as illustrated in views (a) and (b) of FIG. 3, the flat tubes 150 themselves are each folded so that the refrigerant inlet and outlet are positioned on the same end portion side in each of the heat exchange units (hairpin-shaped structure). As illustrated in view (c) of FIG. 3, each of the flat tubes 150 has a plurality of refrigerant channels 151 therein arranged in the long side direction. The refrigerant for heat exchanging with, for example, the air from the turbofan 201 flows through the refrigerant channels 151.

The plate-shaped plate fins 140 are parallel to one another and spaced apart from one another at regular intervals in a refrigerant channel direction (a direction perpendicular to the flat tube 150 arrangement direction). Here, each of the plate fins 140 has a plurality of insertion holes 141 in the longitudinal direction (flat tube 150 arrangement direction, vertical direction in FIG. 1). For example, the number of insertion holes 141 and intervals at which the insertion holes 141 are spaced apart from one another are the same as those of the flat tubes 150 so as to correspond to the flat tubes 150 (except for both ends). Furthermore, the plate fins 140 have slits 142 between the insertion holes 141. The slits 142 are formed by cutting and bending part of the plate fins 140.

Here, by arranging the distributors 110, the flow rate-regulating capillary tubes 120, and the headers 130 close to one another in the indoor unit 200, the inner capacity of the indoor unit 200 can be effectively used. Accordingly, in Embodiment 1, as illustrated in FIG. 2, the distributor 110, the flow rate-regulating capillary tubes 120, and the header 130 of each of the heat exchange units are disposed at positions close to one another (front position in FIG. 2) in the indoor unit 200 and connected to the refrigerant pipes. In order to realize such a configuration, it is preferable that the refrigerant inlets and outlets of the flat tubes 150 be positioned on the same side. Thus, pipes in the indoor unit 200 do not become complex and are arranged at positions close to one another. Thus, work relating to the manufacture such as connection and installation of the pipes can be easily performed.

In this structure, in the heat exchanger of the four-way cassette-type indoor unit, in order to position the refrigerant inlets and outlets of the flat tubes on the same side with a substantially rectangular enclosure, it is considered that one heat exchange unit is bent at three positions. In this case, the flat tubes 150 each need to be bent a plurality of times. Here, the flat tubes and the plate fins are generally joined to one another by brazing, and the fins may buckle due to the bending performed many times. Thus, the number of bending is preferably as much reduced as possible. In the heat exchanger 100 of Embodiment 1, the turbofan 201 is surrounded by the substantially rectangular enclosure formed by combining two L-shaped heat exchange units, in each of which the flat tubes 150 are each bent once. In order to position the refrigerant inlets and outlets of the flat tubes 150 on the same side in each of the heat exchange units, the flat tubes 150 are bent into a U-shape on the other side (rear side in FIG. 2) so as to have a hairpin-shaped structure. With the hairpin-shaped structure, pipework or other manufacturing work is limited to only on the one end side of the heat exchange units (no need for work at both the sides). Since the work on the other side is not necessary, many plate fins 140 can be stacked (arranged) correspondingly. Thus, the ratio of mounting area can be increased. Furthermore, the L-shaped heat exchange units are combined with each other to form the rectangular heat exchanger. Thus, compared to a heat exchanger that uses a single rectangular heat exchange unit, the length of each of the channels is halved in the entirety of the heat exchanger, and accordingly, pressure loss of the refrigerant can be reduced to about the half.

Figure 4:
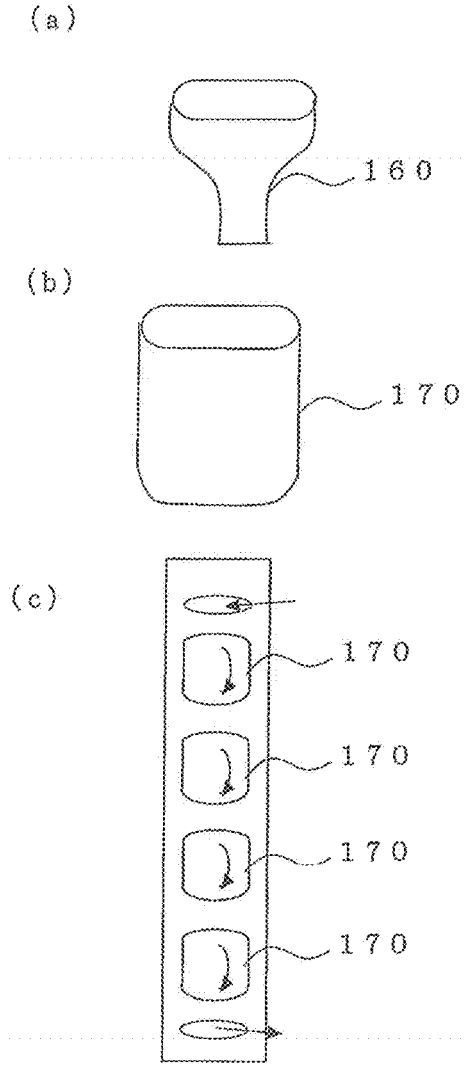
FIG. 4 includes views of components relating to connection of the flat tubes 150 according to Embodiment 1 of the present invention.

FIG. 4 includes views of components relating to connection of the flat tubes 150 according to Embodiment 1 of the present invention. Referring to view (a) of FIG. 4, a circular tube joint 160 is a joint for connecting the flat tube 150 to the header 130 and the flow rate-regulating capillary tube 120 having circular tubes, and accordingly, has openings conforming to the shapes of these components.

Referring to view (b) of FIG. 4, a U-bend 170 is used to connect the outlet of the flat tube 150 on the upper side to the flat tube 150 on the lower side on the front side in FIG. 2 when, for example, the refrigerant channels are integrated into a single channel without distributing or combining the refrigerant in the heat exchange unit (see view (c) of FIG. 4). The flow of the refrigerant having flowed out of, for example, the uppermost flat tube 150 is repeatedly turned around on the front and rear sides and flows out of the lowermost flat tube 150 of the heat exchange unit. Here, when all the refrigerant inlets and all the refrigerant outlets of the heat exchange unit are respectively integrated into a single refrigerant inlet and a single refrigerant outlet with the U-bends 170, installation of the aforementioned distributor 110, the flow rate-regulating capillary tubes 120, and the header 130 (the branching and combining means) is unnecessary.

Next, the flow of the refrigerant in the heat exchanger 100 in Embodiment 1 is described. Here, the heat exchanger 100 is assumed to function as the evaporator. The two-phase gas-liquid refrigerant having flowed into each of the distributors 110 is subjected to regulation of the flow rates in branched channels by flow resistances in the flow rate-regulating capillary tubes 120 and, after that, flows into the flat tubes 150 connected by the circular tube joints 160. The refrigerant having flowed into the flat tubes 150 flows through the refrigerant channels 151. The refrigerant turns around at bent portions on the other side (rear side in FIG. 2) and flows into the header 130 on the same side as the inlet side. Here, the refrigerant is evaporated and the state thereof is changed into the gaseous state while flowing through the refrigerant channels 151 due to heat exchange with the air, which is caused to pass through the heat exchanger 100 by the turbofan 201. Then, the flows of the refrigerant are combined by the header 130, and the combined flow of the refrigerant flows into the refrigerant pipe on the gas side.

As described above, according to the indoor unit 200 of Embodiment 1, the heat exchanger 100 is formed by combining two heat exchange units each including the flat tubes 150, which are bent to have an L-shape. Thus, compared to the case where the enclosure of the heat exchanger is formed by four heat exchange units, the ratio of the mounting area contributing to heat exchange can be increased. Furthermore, compared to a heat exchanger that uses a single heat exchange unit formed by being bent a plurality of times to have a rectangular shape, the length of each of the channels is substantially halved in the entirety of the heat exchanger, and accordingly, pressure loss of the refrigerant can be reduced to about the half. Thus, air-conditioning performance can be improved.

Embodiment 2

Although the example of the heat exchange unit has a single row structure in Embodiment 1 described above, the technique described herein may also be applied to the heat exchange unit having two or more rows.

Figure 5:
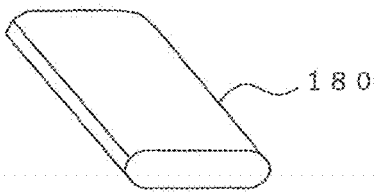
FIG. 5 includes views of components relating to connection of the flat tubes 150 according to Embodiment 2 of the present invention.
Figure 5:
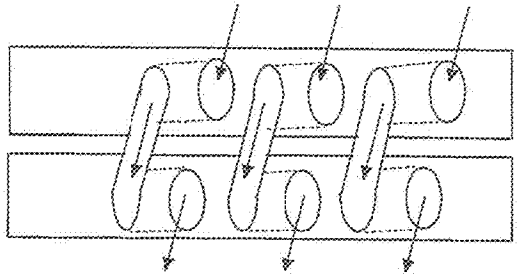

FIG. 5 includes views of components relating to connection of the flat tubes 150 according to Embodiment 2 of the present invention. For example, in order to connect the flat tubes arranged in rows to one another, oblique U-bends 180 illustrated in view (a) of FIG. 5 connect the flat tubes in adjacent rows to one another on the front side in FIG. 2 (see view (b) of FIG. 5). Arrows in view (b) of FIG. 5 indicate the flows of the refrigerant.

Embodiment 3

Although the heat exchanger 100 (heat exchange units) includes the flat tubes 150 having a hairpin-shaped structure in Embodiments described above, the present invention is not limited to this. For example, two flat tubes may be joined to each other by the U-bend so that the refrigerant inlet and the refrigerant outlet of the flat tubes are positioned on the same side. Alternatively, a joint that connects the flat tube to a circular tube may be attached to the flat tubes, and the connection is made by a U-bend for a circular tube.

Alternatively, two flat tubes may be connected to each other by the header so that the refrigerant inlet and the refrigerant outlet thereof are positioned on the same side. In this case, the two-phase gas-liquid refrigerant being evaporated or condensed passes through the header. Thus, it is preferable that the interior of the header be separated so that the flows of the refrigerant passing through the flat tubes are not mixed together.

Embodiment 4

Figure 6:
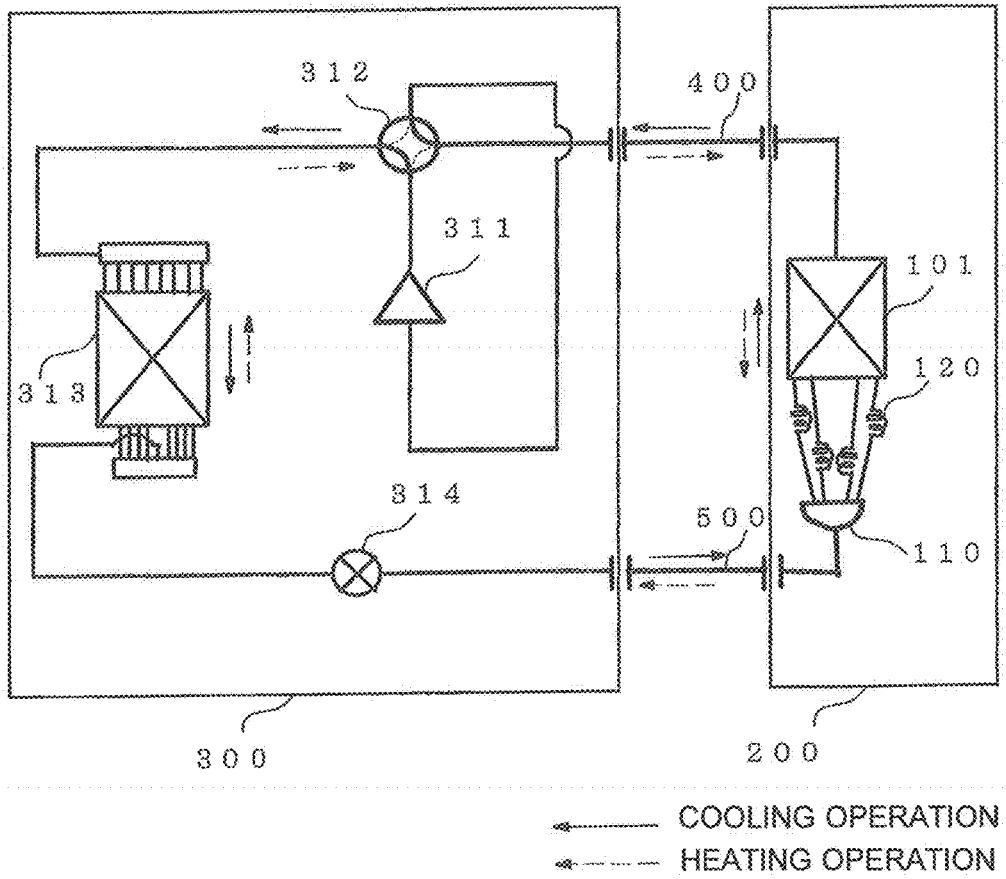
FIG. 6 illustrates an example of a configuration of a refrigeration cycle apparatus according to Embodiment 4 of the present invention.

FIG. 6 illustrates an example of a configuration of a refrigeration cycle apparatus according to Embodiment 4 of the present invention. Here, in FIG. 6, an air-conditioning apparatus is illustrated as the refrigeration cycle apparatus. In FIG. 6, operations of the components that have been described with reference to, for example, FIG. 1 are similar to those having been described. In the air-conditioning apparatus illustrated in FIG. 6, an outdoor unit 300 and the indoor unit 200 are connected to each other through a gas refrigerant pipe 400 and a liquid refrigerant pipe 500. The outdoor unit 300 includes a compressor 311, a four-way valve 312, an outdoor heat exchanger 313, and an expansion valve 314. The indoor unit 200 includes an indoor heat exchanger 101, which is the heat exchanger 100 described in Embodiment 1, the distributor 110, and the flow rate-regulating capillary tubes 120.

The compressor 311 compresses a sucked refrigerant and discharges the compressed refrigerant. Here, although it is not limiting, the compressor 311 may have a capability of varying the capacity (amount of refrigerant fed per unit time) thereof by arbitrarily varying an operating frequency with, for example, an inverter circuit or the like. The four-way valve 312 is a valve that switches the flow of the refrigerant between, for example, the flow for a cooling operation and the flow for a heating operation.

The outdoor heat exchanger 313 according to Embodiment 4 exchanges heat between the refrigerant and the air (outdoor air). For example, during the heating operation, the outdoor heat exchanger 313 functions as the evaporator, evaporating and gasifying the refrigerant. During, the cooling operation, the outdoor heat exchanger 313 functions as the condenser, condensing and liquefying the refrigerant.

The expansion valve 314 of an expansion device (flow-rate control means) or the like reduces the pressure of and expands the refrigerant. When, for example, the expansion valve 314 uses an electronic expansion valve or the like, an opening degree is adjusted in accordance with an instruction from control means (not illustrated) or the like. The indoor heat exchanger 101 exchanges heat between, for example, the air subjected to air-conditioning and the refrigerant. During, the heating operation, the indoor heat exchanger 101 functions as the condenser, condensing and liquefying the refrigerant. Meanwhile, during the cooling operation, the indoor heat exchanger 101 functions as the evaporator, evaporating and gasifying the refrigerant.

Initially, the cooling operation of the refrigeration cycle apparatus is described in accordance with the flow of the refrigerant. In the cooling operation, the four-way valve 312 is switched so as to establish a connection relationship indicated by solid lines. The high-temperature high-pressure gaseous refrigerant compressed by and discharged from the compressor 311 passes through the four-way valve 312 and flows into the outdoor heat exchanger 313. Then, the refrigerant passes through the outdoor heat exchanger 313 and exchanges heat with the outdoor air, thereby the refrigerant is condensed and liquefied. The refrigerant (liquid refrigerant) flows into the expansion valve 314. The pressure of the refrigerant is reduced by the expansion valve 314, and the refrigerant, which has entered a two-phase gas-liquid state, flows out of the outdoor unit 300.

The two-phase gas-liquid refrigerant having flowed out of the outdoor unit 300 passes through the liquid refrigerant pipe 500 and flows into the indoor unit 200. The refrigerant is distributed by the distributor 110 and the flow rate-regulating capillary tubes 120 and flows into the indoor heat exchanger 101. As described above, the refrigerant passes through the flat tubes 150 of the indoor heat exchanger 101 and exchanges heat with, for example, the air subjected to air-conditioning. This causes the refrigerant to be evaporated and gasified. The refrigerant (gas refrigerant) flows out of the indoor unit 200.

The gas refrigerant having flowed out of the indoor unit 200 passes through the gas refrigerant pipe 400 and flows into the outdoor unit 300. The refrigerant then passes through the four-way valve 312 and is sucked into the compressor 311 again. Thus, the refrigerant of the air-conditioning apparatus is circulated and air-conditioning (cooling) is performed.

Next, the heating operation is described in accordance with the flow of the refrigerant. In the heating operation, the four-way valve 312 is switched so as to establish a connection relationship indicated by dotted lines. The high-temperature high-pressure gaseous refrigerant compressed by and discharged from the compressor 311 passes through the four-way valve 312 and flows out of the outdoor unit 300. The gas refrigerant having flowed out of the outdoor unit 300 passes through the gas refrigerant pipe 400 and flows into the indoor unit 200.

The refrigerant, which has been passed through the flat tubes 150 of the indoor heat exchanger 101 and condensed and liquefied by exchanging heat with, for example, the air subjected to air-conditioning, passes through the distributor 110 and the flow rate-regulating capillary tubes 120 and flows out of the indoor unit 200.

The refrigerant having flowed out of the indoor unit 200 passes through the liquid refrigerant pipe 500 and flows into the outdoor unit 300. Then, the pressure of the refrigerant is reduced by the expansion valve 314, and the refrigerant, which has entered a two-phase gas-liquid state, flows into the outdoor heat exchanger 313. Then, the refrigerant passes through the outdoor heat exchanger 313 and exchanges heat with the outdoor air, thereby the refrigerant is evaporated and gasified. The gasified refrigerant (gas refrigerant) passes through the four-way valve 312 and is sucked into the compressor 311 again. Thus, the refrigerant of the air-conditioning apparatus is circulated and air-conditioning (heating) is performed.

As described above, in the air-conditioning apparatus (refrigeration cycle apparatus) according to Embodiment 4, the air-conditioning apparatus exhibiting high heat exchange efficiency can be obtained by using the above-described indoor unit 200. Accordingly, energy can be saved. Furthermore, the size of the indoor unit 200 can be reduced. Thus, the cost of the production and the like can be reduced.

INDUSTRIAL APPLICABILITY

Above Embodiments described the heat exchanger corresponds to the air flows in four directions. However, the technique herein can be applied to heat exchangers that correspond to the air flows in, for example, two directions and three directions. The technique herein can be applied not only to the heat exchanger of the indoor unit but also to a heat exchanger disposed in the outdoor unit.

The invention claimed is:

1. A heat exchanger comprising:

a plurality of heat exchange units, each of the heat exchange units including a plurality of plate fins arranged spaced apart from one another at intervals so as to allow air to flow therebetween, and a plurality of flat tubes each having an L shape, the flat tubes being joined to the plate fins so that the flat tubes serve as refrigerant channels in a direction in which the plate fins are arranged, wherein the heat exchange units are combined with each other so as to form a rectangular shape.

2. The heat exchanger of claim 1, wherein, in each of the heat exchange units, the flat tubes each have a hairpin shape so that a refrigerant inlet of the flat tube is positioned on a same end side of the heat exchange unit as an end side of the heat exchange unit where a refrigerant outlet of the flat tube is positioned.

3. The heat exchanger of claim 2, wherein, the refrigerant outlet of one of the plurality of flat tubes is connected to the refrigerant inlet of another one of the plurality of flat tubes by a U-bend.

4. The heat exchanger of claim 2, wherein the heat exchange units are arranged in a plurality of rows in a direction in which the air flows, and wherein the refrigerant outlets of the flat tubes in one of the rows are connected to the refrigerant inlets of the flat tubes in another one of the rows by oblique U-bends.

5. The heat exchanger of claim 1, wherein the flat tubes are connected to circular tubes by circular tube joints.

6. The heat exchanger of claim 1, further comprising:

a refrigerant branching and combining unit that causes a flow of the refrigerant flowing into the flat tubes to branch and that causes the flows of the refrigerant flowing out of the flat tubes to be combined with one another.

7. The heat exchanger of claim 1, wherein the components of the heat exchanger are each formed of aluminum or a material containing aluminum.

8. An indoor unit comprising:

the heat exchanger of claim 1; and an air-sending device surrounded by the heat exchanger, the air-sending device radially blowing sucked air so that the air passes through the heat exchanger.

9. A refrigeration cycle apparatus comprising:

a refrigerant circuit that includes a compressor that compresses a refrigerant and discharges the compressed refrigerant, a condenser that condenses the refrigerant through heat exchange, an expansion device that reduces a pressure of the refrigerant relating to the condensation, and an evaporator that causes the refrigerant relating to the pressure reduction to exchange heat with air so as to evaporate the refrigerant, wherein the refrigerant circuit is formed by connecting the compressor, the condenser, the expansion device, and the evaporator to one another through pipes, and wherein at least one of the evaporator and the condenser is the heat exchanger of claim 1.

* * * * *